US011339662B2

(12) United States Patent
Kury et al.

(10) Patent No.: US 11,339,662 B2
(45) Date of Patent: May 24, 2022

(54) ROTOR COMPRISING A ROTOR COMPONENT ARRANGED BETWEEN TWO ROTOR DISKS

(71) Applicant: Siemens Energy Global GmbH & Co. KG, Bayern (DE)

(72) Inventors: Peter Kury, Essen (DE); Harald Hoell, Wächtersbach (DE); Karsten Kolk, Mülheim a.d. Ruhr (DE); Vyacheslav Veitsman, Gelsenkirchen (DE); Yulia Bagaeva, Leningradskaya obl. (RU); Christopher W Ross, Oviedo, FL (US); Peter Schröder, Essen (DE); Andrew Waddell, York, SC (US)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/261,044

(22) PCT Filed: Jul. 24, 2019

(86) PCT No.: PCT/EP2019/069866
§ 371 (c)(1),
(2) Date: Jan. 18, 2021

(87) PCT Pub. No.: WO2020/025406
PCT Pub. Date: Feb. 6, 2020

(65) Prior Publication Data

US 2021/0310359 A1 Oct. 7, 2021

Related U.S. Application Data

(60) Provisional application No. 62/713,572, filed on Aug. 2, 2018.

(51) Int. Cl.
*F01D 5/06* (2006.01)
*F01D 5/30* (2006.01)
*F01D 11/00* (2006.01)

(52) U.S. Cl.
CPC ..... *F01D 5/066* (2013.01); *F01D 5/3015* (2013.01); *F01D 5/3007* (2013.01);
(Continued)

(58) Field of Classification Search
CPC ..... F01D 11/001; F01D 11/006; F01D 5/066; F01D 5/3015; F01D 5/3007; F01D 5/326
See application file for complete search history.

(56) References Cited

U.S. PATENT DOCUMENTS 2,656,147 A * 10/1953 Brownhill ..... F01D 5/084 416/97 R
3,343,806 A * 9/1967 Bobo ..... F01D 5/081 415/115
(Continued)

FOREIGN PATENT DOCUMENTS

DE 102014115197 A1 4/2015
EP 0169800 A1 1/1986
(Continued)

OTHER PUBLICATIONS

PCT International Search Report and Written Opinion of International Searching Authority dated Oct. 15, 2019 corresponding to PCT International Application No. PCT/EP2019/069866 filed Jul. 24, 2019.

*Primary Examiner* — Woody A Lee, Jr.
*Assistant Examiner* — Behnoush Haghighian
(74) *Attorney, Agent, or Firm* — Wolter Van Dyke Davis, PLLC

(57) ABSTRACT

A rotor of a gas turbine, having two adjacent rotor disks having a plurality of blade-holding grooves for receiving
(Continued)

rotor blades, distributed around the periphery thereof, and having an axially extending peripheral ring projection radially beneath the blade-holding grooves. A peripheral rotor component is fixed to the ring projections, between the rotor disks. In order to protect the periphery, the rotor disk or the rotor component includes at least two recesses arranged on the periphery in a distributed manner, in each of which engaging shoulders of the rotor component or the rotor disk engage.

15 Claims, 3 Drawing Sheets

(52) U.S. Cl.
CPC ..... *F01D 11/001* (2013.01); *F01D 11/006* (2013.01); *F05D 2220/32* (2013.01)

(56) References Cited

U.S. PATENT DOCUMENTS 4,645,424 A * 2/1987 Peters ..... F01D 5/026 416/198 A
4,659,285 A * 4/1987 Kalogeros ..... F01D 11/006 416/95
4,659,289 A * 4/1987 Kalogeros ..... F01D 5/3015 416/198 A
4,664,599 A * 5/1987 Robbins ..... F01D 5/066 416/198 A
4,669,959 A * 6/1987 Kalogeros ..... F01D 5/3015 415/199.5
4,743,164 A * 5/1988 Kalogeros ..... F01D 5/3007 416/193 A
5,236,302 A * 8/1993 Weisgerber ..... F01D 11/001 415/173.7
5,318,405 A * 6/1994 Meade ..... F01D 5/323 416/220 R
5,320,488 A * 6/1994 Meade ..... F01D 5/025 415/173.7
5,338,154 A * 8/1994 Meade ..... F01D 11/005 415/173.7
5,352,087 A * 10/1994 Antonellis ..... F01D 11/001 415/115
6,190,131 B1 * 2/2001 Deallenbach ..... F01D 5/3015 416/144
6,416,282 B1 * 7/2002 Beeck ..... F01D 5/087 415/115
6,769,865 B2 * 8/2004 Kress ..... F01D 25/12 415/113
6,899,520 B2 * 5/2005 Habedank ..... F01D 5/06 415/174.5
7,500,832 B2 * 3/2009 Zagar ..... F01D 5/3015 416/220 R
8,206,119 B2 * 6/2012 Liotta ..... F01D 11/005 416/220 R
8,221,062 B2 * 7/2012 Liotta ..... F01D 11/006 415/173.7
8,226,366 B2 * 7/2012 Brucher ..... F01D 5/3015 416/221
8,459,951 B2 * 6/2013 Arrell ..... F04D 29/321 416/201 R
8,608,436 B2 * 12/2013 Wines ..... F01D 5/066 415/174.2
8,920,121 B2 * 12/2014 Dungs ..... F01D 11/006 416/97 R
10,041,362 B2 * 8/2018 Belshaw ..... F01D 5/081
10,087,769 B2 * 10/2018 Dungs ..... F01D 5/3015
10,125,621 B2 * 11/2018 Barry ..... F01D 5/02
10,196,916 B2 * 2/2019 Matthews ..... F01D 5/02
10,480,338 B2 * 11/2019 Webb ..... F01D 5/326
10,557,356 B2 * 2/2020 Wines ..... F01D 5/3007
10,724,375 B2 * 7/2020 Prescott ..... F01D 9/041
10,760,435 B2 * 9/2020 Dawson ..... F01D 5/326
10,920,598 B2 * 2/2021 Whitten ..... F01D 5/3015
2005/0047910 A1 * 3/2005 Habedank ..... F01D 5/06 415/173.7
2010/0196164 A1 * 8/2010 Liotta ..... F01D 11/005 416/220 R
2012/0034087 A1 * 2/2012 Dungs ..... F01D 5/3015 416/219 R
2012/0051917 A1 * 3/2012 Wines ..... F01D 5/066 416/179
2015/0114001 A1 4/2015 Potter
2016/0090850 A1 * 3/2016 Barry ..... F01D 5/02 416/221
2016/0090854 A1 * 3/2016 Webb ..... F01D 5/3015 416/220 R
2016/0265378 A1 * 9/2016 Dungs ..... F01D 5/12
2017/0292396 A1 * 10/2017 Matthews ..... F01D 5/02
2018/0320532 A1 * 11/2018 Whitten ..... F01D 11/006

FOREIGN PATENT DOCUMENTS

EP 1079070 A2 2/2001
EP 3287595 A1 2/2018
EP 3318724 A1 5/2018

* cited by examiner

ROTOR COMPRISING A ROTOR COMPONENT ARRANGED BETWEEN TWO ROTOR DISKS

CROSS REFERENCE TO RELATED APPLICATIONS

This application is the US National Stage of International Application No. PCT/EP2019/069866 filed 24 Jul. 2019, and claims the benefit thereof. The International Application claims the benefit of US Provisional Application No. 62/713,572 filed 2 Aug. 2018. All of the applications are incorporated by reference herein in their entirety.

FIELD OF INVENTION

The invention relates to a rotor of a gas turbine which has at least two interconnected rotor disks, between which an annular rotor component is arranged.

BACKGROUND OF INVENTION

Various designs of rotors are known from the prior art for use in gas turbines with interconnected rotor disks, wherein an annular rotor component is arranged between the rotor disks for the purpose of shielding the inner region of the rotor from the hot gas which flows through the gas turbine. The two rotor disks hereby each have a plurality of rotor blades distributed over the outer circumference. A row of guide blades arranged distributed over the circumference which are in each case fastened to the stationary housing is situated between the two rows of rotor blades. A gap is hereby necessarily present between the guide blades and the rotor blades owing to the rotation of the rotor. This could in principle enable the ingress of hot gas into the region radially inside the guide blades. In order to hold back the hot gas from inside the rotor, in some gas turbines an annular rotor component is arranged between the two adjacent rotor disks. For this purpose, this rotor component is mounted on both sides of the rotor disk.

The rotor component fundamentally has the sole object of preventing the penetration of hot gas. A further function does not generally exist. Accordingly, the mounting of the rotor component is maintained simply in a customary fashion, wherein only one annular, axially extending projection engages in a corresponding annular groove.

Undesired rotation of the rotor component relative to the rotor disks is generally speaking prevented by there being a press-fit at at least one point between the rotor component and one of the rotor disks engaging with the annular projection in the annular groove.

Although the known designs have generally speaking proven to be suitable, operating states can nevertheless occur in which the press-fit is insufficient to be able to prevent a relative rotation of the rotor component. As long as no damage occurs hereby, this is usually tolerated for the rotationally symmetrical rotor component.

Given the demand for an increased lifetime of the rotor, an undesired relative movement between the rotor component and the rotor disks is, however, seen to be critical in ensuring that the goal of increasing the lifetime is not compromised as a result.

A solution to this problem is known, for example, from EP 0169800 A1. In this solution, two adjacent rotor disks in each case have an opposite, annular axially extending protrusion. A rotor component for sealing the region between the two rotor disks is arranged between the rotor disks. It has, at both axial ends, in each case a circumferential projection which in each case bears against a protrusion of the corresponding rotor disk on the side facing the rotor axis. In order to prevent relative displacement of the rotor component relative to the rotor disks, in this case it is provided that a protrusion has recesses in which the engagement projections of the rotor component engage.

It is furthermore known from the known design to cover the blade retaining grooves of a rotor disk with a side plate. The rotor component is hereby used to fix the side plates.

Although the known design has proven itself fundamentally, the demand for greater sealing has led to the realization that a one-piece design of the rotor component and side plate would be advantageous. However, up until now such a design has failed owing to the deformations which occur at the rotor component.

SUMMARY OF INVENTION

An object of the present invention is therefore make available a rotor component by means of which the region between two rotor disks can advantageously be sealed and the blade retaining grooves of a rotor disk can be covered at least partially.

The object set is achieved by the embodiment according to the invention as claimed in the independent claim. Advantageous embodiments are the subject of the subclaims.

The generic rotor serves first of all for use in a gas turbine. However, it is also possible, independently thereof, to apply the embodiment of the rotor to other continuous-flow machines, for example a steam turbine.

The rotor at least has a first rotor disk and a second rotor disk connected directly and rigidly to the first rotor disk. The rotor disks hereby have a plurality of blade retaining grooves which in each case pierce the respective rotor disk, distributed over the outer circumference. The blade retaining grooves hereby serve to accommodate rotor blades.

The first rotor disk furthermore has a circumferential first annular protrusion extending axially toward the second rotor disk, radially below the blade retaining grooves. In a similar fashion, the second rotor disk has a circumferential second annular protrusion extending axially toward the first rotor disk, radially below the blade retaining grooves.

An annular rotor component is arranged between the two rotor disks in the region of the blade retaining grooves and/or radially below the blade retaining grooves. It surrounds the rotor which is partially situated inside the rotor component or surrounds parts of the two rotor disks. The rotor component has a circumferential support section at each of its two axial ends for the purpose of centering the rotor component relative to the rotor disks and at the same time of fastening it. The first support section is hereby situated on the side facing the rotor axis, below the first annular protrusion, and the second support section is situated radially below the second annular protrusion. It can here be provided that the respective support section bears against the annular protrusion with a press-fit or leaves a slight gap (to ensure the centering) from the annular protrusion.

In order to ensure the lifetime at the connection between the rotor component and the rotor disks, a coupling is produced between the rotor component of the first rotor disk, radially outside the annular protrusion, which prevents a relative displacement in the circumferential direction.

For this purpose, in a first embodiment the first rotor disk has at least two first recesses arranged distributed over the circumference. In contrast, the rotor component has complementary second engagement projections which in each case engage in a corresponding first recess.

In a second embodiment, the first rotor disk has at least two first engagement projections arranged distributed over the circumference. For this purpose, the rotor component has complementary second recesses such that the first engagement section engages in the second recesses.

A reliable coupling between the rotor component and the rotor disks is effected by the embodiment such that a relative movement is prevented even when a press-fit is lost. In this respect, no friction between the components can occur and negatively influence the lifetime.

According to the invention, shielding from the hot gas is now improved if the rotor component furthermore has at least one circumferential radially extending disk section. The latter is hereby arranged at one axial end and can partially cover the rotor disk and the blade retaining grooves.

Advantageous stabilization of the rotor component, in particular of the disk section, and advantageous securing of the connection between the rotor component and the rotor disks is achieved according to the invention by the disk section having a first region with a first material thickness in the axial direction and, radially outside the first region, a second region with an increased and hereby at least double material thickness.

For the purpose of advantageously connecting the rotor component to the rotor disks, the rotor component has at one axial end an axially open first annular groove surrounding the first annular protrusion and, opposite it at the other axial end, an axially open second annular groove surrounding the second annular protrusion. The flanks of the respective annular groove which are situated on the side facing the rotor axis are formed by the support sections.

The centering of the rotor component relative to the rotor disks in different operating states can be improved if a radially outer flank of the first annular groove furthermore bears against the first annular protrusion or a radially outer flank of the second annular groove bears against the second annular protrusion.

The second recesses in the first rotor disk and/or the second recesses in the rotor component can take a different form. In a simple embodiment, for this purpose the first rotor disk or the rotor component has a circumferential annular projection. The recess correspondingly hereby accommodates the circumferential annular projection.

In an alternative embodiment, the recess is limited on both sides by protrusions which extend partially in the circumferential direction.

It is hereby particularly advantageous if an engagement projection is arranged on both sides of a respective recess. In this respect, alternately and adjacently in the circumferential direction, a first engagement projection of the first rotor disk thus engages in a second recess of the rotor component and a second engagement projection of the rotor component engages in a first recess of the first rotor disk.

In order to advantageously arrange the first engagement sections for the first rotor disk, these are each positioned centrally between two blade retaining grooves. It is correspondingly advantageous if the first recesses are in each case arranged in an extension of the blade retaining grooves.

Irrespective of the radial positioning of the first engagement sections, the latter advantageously have a length in the circumferential direction which is smaller than the smallest distance between two blade retaining grooves.

In an alternative embodiment, the connection is arranged directly above the annular protrusion. For this purpose, the first rotor disk has the first engagement projections on the radially outward facing side of the annular protrusion. In a complementary fashion, the second recesses are required in the rotor component. In this embodiment, the rotor component advantageously has a first annular groove in which the first annular protrusion engages. The recess can consequently be arranged on the radially outer situated flank of the annular groove. The first engagement projection and hence the second recess can thus be arranged advantageously spaced apart from the axially free end of the annular protrusion. Additional loading can thus be avoided by the second recess in the region of the groove base of the first annular groove.

The engagement projections can take a different form. A reliable connection to the engagement projections is created if they are formed integrally with the first rotor disk or integrally with the rotor component.

In an alternative embodiment, however, it is also conceivable that the engagement projections are fitted undetachably, by being welded or soldered, or detachably. It should, however, hereby be taken into account that the position of the fitted engagement projection is ensured in each case. A weakening of the component (first rotor disk or rotor component) may hereby furthermore be associated with the engagement projection. It is also conceivable that, when an engagement projection is fitted in place, the latter causes a different load under centrifugal force than an integrally formed engagement projection.

A thickened area is arranged for this purpose in order to form the second region on the immediately adjacent averted side. Owing to the non-uniform weight distribution between the first region and the second region, when the centrifugal forces occur this results in a slight bending moment of the free end of the disk section in the direction of the immediately adjacent rotor disk.

The arrangement of the second recesses and/or the second engagement projections on the rotor component is effected hereby particularly advantageously in the second region of the disk section.

BRIEF DESCRIPTION OF THE DRAWINGS

Two exemplary embodiments for a rotor according to the invention in the region of the rotor component are depicted partially in the following drawings, in which.

DETAILED DESCRIPTION OF INVENTION

Figure 1:
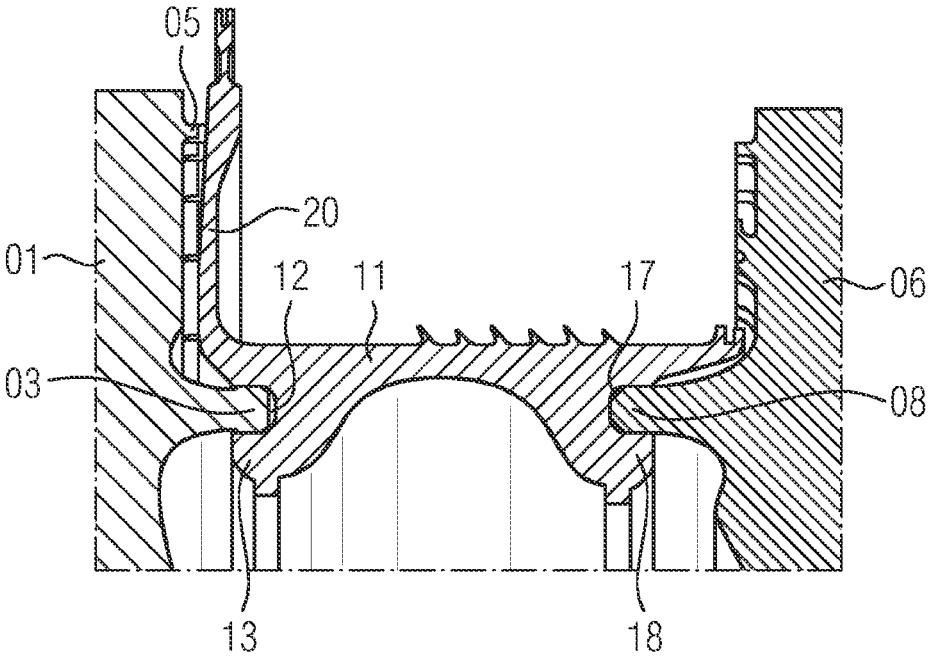
FIG. 1 shows part of the rotor in a longitudinal section in the region of the rotor component in a first embodiment.

A rotor in a first exemplary embodiment is depicted in a longitudinal section in FIG. 1 only in the region of the rotor component 1. Further configuration of the rotor can be selected with the aid of customary embodiments. The rotor at least has a first rotor disk 01 and a second rotor disk 06. A circumferential axially extending annular protrusion 03, 08 is in each case arranged on said rotor disks 01, 06.

The rotor component 11 which has a respective circumferential annular groove 12, 17 for attachment to the rotor disks 01, 06 is situated between the rotor disks 01, 06, wherein the first annular protrusion 03 engages in the first annular groove 12, and the second annular protrusion 08 engages in the second annular groove 17. A support section 13, 18 formed by the rotor component 11 is situated radially below the respective annular protrusion 03, 08. Said support sections 13, 18 are supported on the respective annular protrusion 03, 08 at least when centrifugal force is present.

It can furthermore be seen that the rotor component 11 has a circumferential radially extending disk section 20.

The coupling between the rotor component 11 and the first rotor disk 01 is situated in the radially outer region in this exemplary embodiment.

Figure 2:
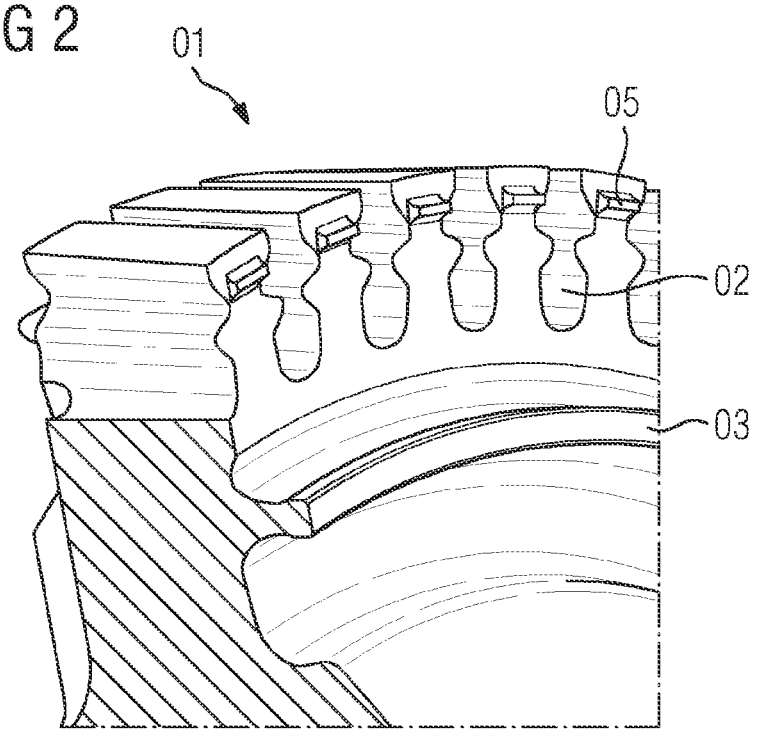
FIG. 2 shows the first rotor disk to be implemented from FIG. 1.

FIG. 2 depicts the first rotor disk 01 in a perspective view. The circumferential annular protrusion 03 and, radially outside, the blade retaining grooves 02 which axially pierce the first rotor disk 01 can be seen. A first engagement projection 05 is situated between in each case two blade retaining grooves 02. A corresponding first recess is situated between in each case two engagement sections 05.

Figure 3:
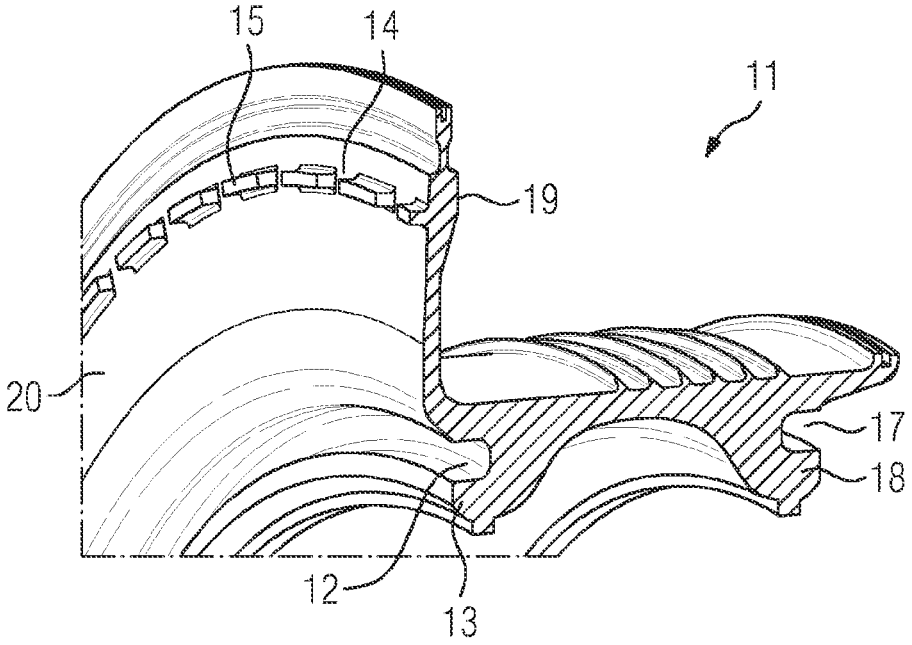
FIG. 3 shows the rotor component to be implemented from FIG. 1.

FIG. 3 shows the rotor component 11 which is complementary hereto. Visible again are the circumferential annular grooves 12, 17 with those support sections 13, 18 which are arranged on the side facing the rotor axis. The disk section 20 which extends radially at one axial end, immediately adjacent to the first rotor disk 01, is divided into a radially inner first region and a radially outer second region, wherein the second region has a thickened area 19 and consequently has at least twice the material thickness of the first region. In order to ensure a reliable coupling between the rotor component 11 and the first rotor disk 01 when centrifugal forces occur, in this exemplary embodiment the second engagement projections 15 arranged on the rotor component 11 and the second recesses 14 situated between them are arranged opposite the thickened area 19 in the radially outer region.

Figure 4:
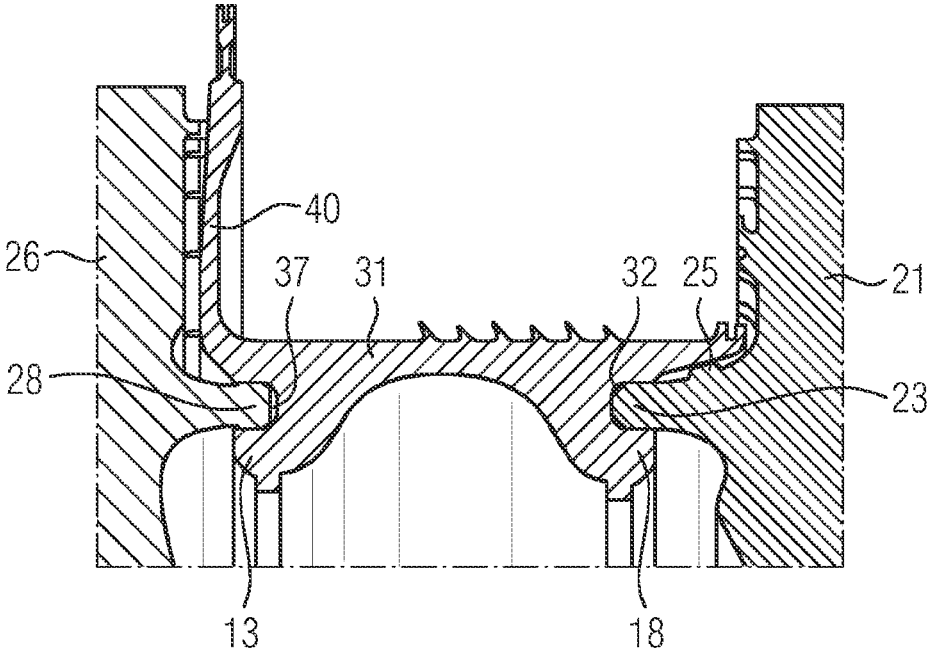
FIG. 4 shows part of the rotor in a longitudinal section in the region of the rotor component in a second embodiment.

In a similar fashion to FIG. 1, FIG. 4 shows a rotor in a second exemplary embodiment. The rotor hereby has a first rotor disk 21 and a second rotor disk 26. A circumferential axially extending annular protrusion 23, 28 is in each case arranged on said rotor disks 21, 26.

The rotor component 31 which has a circumferential annular groove 32, 37 in each case for attachment to the rotor disks 21, 26 is situated between the rotor disks 21, 26.

It can furthermore be seen that the rotor component 31 has a circumferential radially extending disk section 40.

The coupling between the rotor component 31 and the first rotor disk 21 is situated immediately radially outside the first annular protrusion 23.

Figure 5:
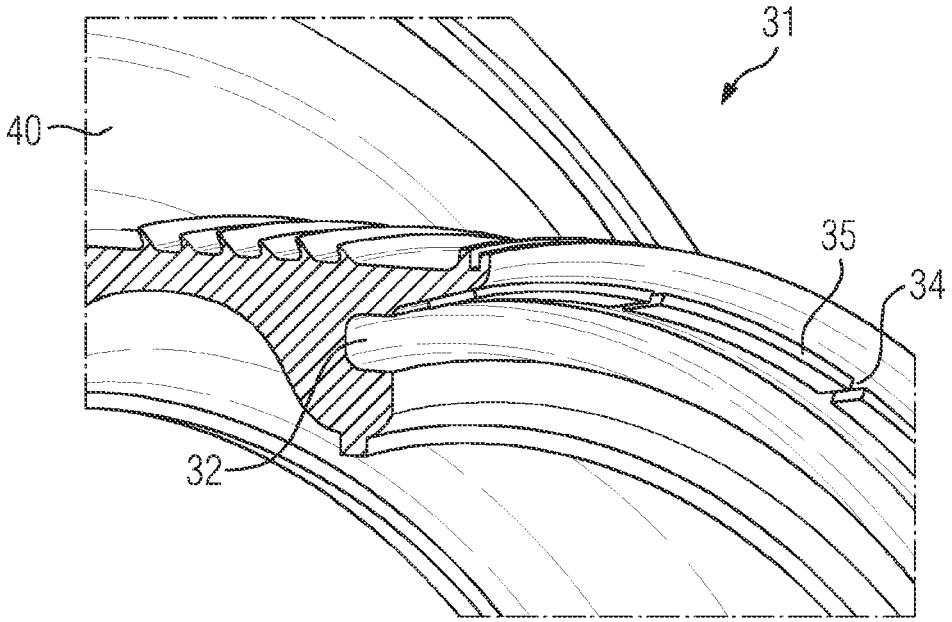
FIG. 5 shows the rotor component to be implemented from FIG. 4.

FIG. 5 shows the rotor component 31 in a perspective view. Visible again is the circumferential first annular groove 32 with the support sections arranged on the side facing the rotor axis. The disk section 40 which extends radially immediately adjacent to the second rotor disk 26 at one axial end has a similar design to that above.

In contrast to the previous design, in this case it is provided that the rotor component has a circumferential annular projection 35 on the radially outer situated flank of the first annular groove 32 on the side facing the rotor axis. Said annular projection 35 is interrupted multiple times by second recesses 34 which are arranged in each case distributed over the circumference.

Figure 6:
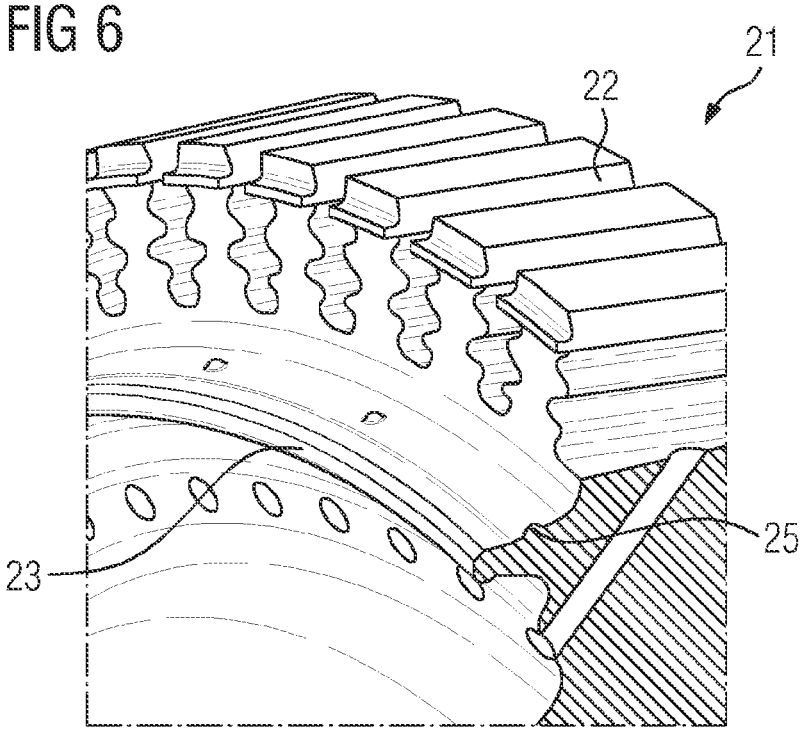
FIG. 6 shows the first rotor disk to be implemented from FIG. 4.

FIG. 6 shows the first rotor disk 21 in a perspective view. The circumferential annular protrusion 23 and the blade retaining grooves 02 can be seen. In order to effect the coupling, the first rotor disk 21 has the first engagement projections 25, which complement the second recesses 34, on the radially outer situated side on the first annular protrusion 23.

The invention claimed is:

1. A rotor, comprising:

a first rotor disk of two rotor disks which comprises, distributed over a circumference, blade retaining grooves which pierce the first rotor disk axially, for accommodating rotor blades and, radially below the blade retaining grooves, an axially extending circumferential first annular protrusion;

a second rotor disk of the two rotor disks, fastened to the first rotor disk, which second rotor disk comprises, distributed over the circumference, of blade retaining grooves which pierce the second rotor disk axially, for accommodating rotor blades and, radially below the blade retaining grooves, a circumferential second annular protrusion which extends axially toward to the first annular protrusion; and a circumferential rotor component, arranged between the two rotor disks, which circumferential rotor component comprises a first support section which comes to bear against the first annular protrusion on the side of the first annular protrusion facing a rotor axis, and a second support section which comes to bear against the second annular protrusion on the side of the second annular protrusion facing the rotor axis;

wherein a geometric interlock configured to prevent circumferential motion of the rotor component relative to at least one of: the first rotor disk; and the first rotor disk and the second rotor disk, comprises at least one of:

first rotor disk recesses disposed on the first rotor disk radially outward of the first annular protrusion and first end engagement projections projecting from and circumferentially fixed relative to a first axial end of the rotor component and configured to cooperate with the first rotor disk recesses; and first rotor disk projections disposed on the first rotor disk radially outward of the first annular protrusion and first end recesses disposed on the first axial end of the rotor component and configured to cooperate with the first rotor disk projections, plus second rotor disk projections disposed on the second rotor disk radially outward of the second annular protrusion and second end recesses disposed on a second axial end of the rotor component and configured to cooperate with the second rotor disk projections; and wherein the first axial end of the rotor component comprises: a radially extending disk section which at least partly covers the blade retaining grooves of the first rotor disk; a first region with a first material thickness; and radially outside the first region, a second region with a material thickness at least double the first material thickness.

2. The rotor as claimed in claim 1, wherein the first axial end of the rotor component comprises an axially open first annular groove surrounding the first annular protrusion and the second axial end of the rotor component comprises an axially open second annular groove surrounding the second annular protrusion.

3. The rotor as claimed in claim 2, wherein a first radially outer flank of the first annular groove bears against the first annular protrusion and a second radially outer flank of the second annular groove bears against the second annular protrusion.

4. The rotor as claimed in claim 1, wherein the geometric interlock comprises the first rotor disk recesses and the first rotor disk projections, and wherein the first rotor disk recesses are disposed between respective first rotor disk projections.

5. The rotor as claimed in claim 1, wherein the geometric interlock comprises the first rotor disk projections;

wherein the first rotor disk projections are arranged in each case in a circumferential direction between two respective blade retaining grooves.

6. The rotor as claimed in claim 5, wherein a length of the first rotor disk projections in the circumferential direction is in each case smaller than or the same as a smallest distance between two blade retaining grooves.

7. The rotor as claimed in claim 1, wherein the second rotor disk projections are arranged on a radially outward facing side of the second annular protrusion, spaced apart from an axially free end of the second annular protrusion.

8. The rotor as claimed in claim 1, wherein the second region is formed by a thickened area on a side of the radially extending disk section facing away from first rotor disk.

9. The rotor as claimed in claim 8, wherein the geometric interlock comprises the first end engagement projections; and wherein the first end engagement projections are arranged in the second region.

10. The rotor as claimed in claim 1, wherein the rotor comprises a rotor of a gas turbine.

11. The rotor as claimed in claim 1, wherein the geometric interlock comprises the second end recesses; and wherein the rotor component comprises a circumferential annular projection in which the second end recesses are disposed.

12. The rotor as claimed in claim 1, wherein the geometric interlock comprises the first rotor disk recesses; and wherein the first rotor disk recesses are arranged in each case in a respective extension of the blade retaining grooves.

13. The rotor as claimed in claim 1, wherein the geometric interlock comprises the first end recesses; and wherein the first end recesses are arranged in the second region.

14. A rotor, comprising:

a first rotor disk of two rotor disks which comprises, distributed over a circumference, blade retaining grooves which pierce the first rotor disk axially, for accommodating rotor blades and, radially below the blade retaining grooves, an axially extending circumferential first annular protrusion;

a second rotor disk of the two rotor disks, fastened to the first rotor disk, which second rotor disk comprises, distributed over the circumference, blade retaining grooves which pierce the second rotor disk axially, for accommodating rotor blades and, radially below the blade retaining grooves, a circumferential second annular protrusion which extends axially toward to the first annular protrusion; and a circumferential rotor component, arranged between the two rotor disks, which circumferential rotor component comprises a first support section which comes to bear against the first annular protrusion on the side of the first annular protrusion facing a rotor axis, and a second support section which comes to bear against the second annular protrusion on the side of the second annular protrusion facing the rotor axis;

wherein a geometric interlock configured to prevent circumferential motion of the rotor component relative to at least one of: the first rotor disk; and the first rotor disk and the second rotor disk, comprises:

first rotor disk recesses disposed on the first rotor disk radially outward of the first annular protrusion and first end engagement projections projecting from and circumferentially fixed relative to a first axial end of the rotor component and configured to cooperate with the first rotor disk recesses; and first rotor disk projections disposed on the first rotor disk radially outward of the first annular protrusion and first end recesses disposed on the first axial end of the rotor component and configured to cooperate with the first rotor disk projections, plus second rotor disk projections disposed on the second rotor disk radially outward of the second annular protrusion and second end recesses disposed on a second axial end of the rotor component and configured to cooperate with the second rotor disk projections; and wherein the first axial end of the rotor component comprises: a radially extending disk section which at least partly covers the blade retaining grooves of the first rotor disk; a first region with a first material thickness; and radially outside the first region, a second region with a material thickness at least double the first material thickness.

15. A rotor, comprising:

a first rotor disk of two rotor disks which comprises, distributed over a circumference, blade retaining grooves which pierce the first rotor disk axially, for accommodating rotor blades and, radially below the blade retaining grooves, an axially extending circumferential first annular protrusion;

a second rotor disk of the two rotor disks, fastened to the first rotor disk, which second rotor disk comprises, distributed over the circumference, blade retaining grooves which pierce the second rotor disk axially, for accommodating rotor blades and, radially below the blade retaining grooves, a circumferential second annular protrusion which extends axially toward to the first annular protrusion; and a circumferential rotor component, arranged between the two rotor disks, which circumferential rotor component comprises a first support section which comes to bear against the first annular protrusion on the side of the first annular protrusion facing a rotor axis, and a second support section which comes to bear against the second annular protrusion on the side of the second annular protrusion facing the rotor axis;

wherein a geometric interlock configured to prevent circumferential motion of the rotor component relative to at least one of: the first rotor disk; and the first rotor disk and the second rotor disk, comprises at least one of:

first rotor disk recesses disposed on the first rotor disk radially outward of the first annular protrusion and first end engagement projections integrally formed with and projecting from a first axial end of the rotor component and configured to cooperate with the first rotor disk recesses; and first rotor disk projections disposed on the first rotor disk radially outward of the first annular protrusion and first end recesses disposed on the first axial end of the rotor component and configured to cooperate with the first rotor disk projections, plus second rotor disk projections disposed on the second rotor disk radially outward of the second annular protrusion and second end recesses disposed on a second axial end of the rotor component and configured to cooperate with the second rotor disk projections; and wherein the first axial end of the rotor component comprises: a radially extending disk section which at least partly covers the blade retaining grooves of the first rotor disk; a first region with a first material thickness; and radially outside the first region, a second region with a material thickness at least double the first material thickness.

* * * * *